United States Patent [19]

Jomha et al.

[11] Patent Number: 4,979,241

[45] Date of Patent: Dec. 25, 1990

[54] TOILET FLUSH CONTROL DEVICE

[76] Inventors: Mohamed A. Jomha, 8815-163 Street, Edmonton, Alberta; Andrew Lazowski, deceased, late of Edmonton; by Greg C. Empson, administrator, #1800 Sun Life Place, 10123-99 Street, Edmonton, Alberta, all of Canada; by Jose Vieira, administrator, 137 Homestead Crescent, Edmonton, Alberta, Canada, T5A 2Y1

[21] Appl. No.: 164,854

[22] Filed: Mar. 7, 1988

[51] Int. Cl.[5] ..... E03D 1/35

[52] U.S. Cl. ..... 4/386; 4/402

[58] Field of Search ..... 4/324, 378, 379, 381, 4/382, 385, 386, 388, 391, 414, 415, 402

[56] References Cited

U.S. PATENT DOCUMENTS

| | | | |
|---|---|---|---|
| 3,036,313 | 5/1962 | Jenkins | 4/395 X |
| 3,921,226 | 11/1975 | MacDonald | 4/324 |
| 3,982,283 | 4/1975 | Goldring | 4/324 X |
| 4,067,074 | 1/1978 | Harrison | 4/324 |
| 4,080,669 | 3/1978 | Biggerstaff | 4/386 |
| 4,134,165 | 1/1979 | Phripp et al. | 4/379 X |

FOREIGN PATENT DOCUMENTS

| | | | |
|---|---|---|---|
| 3541369 | 6/1986 | Fed. Rep. of Germany | 4/324 |

*Primary Examiner*—Stephen Marcus
*Attorney, Agent, or Firm*—William R. Hinds

[57] ABSTRACT

A patented valve control for use in a toilet tank having a bottom outlet for discharging water to a toilet bowl, a valve for closing the outlet, a conventional actuating lever and a chain connecting the lever to the valve for opening the latter, includes an arm carrying the valve pivotally mounted in the toilet tank for actuation by the chain to open the bottom outlet, a float on the arm biasing the valve to the open position when the tank is full and biasing the valve to the close position when the tank is empty, and a drainable container on the arm biasing the valve open when the latter is open and biasing the valve closed when the latter is closed. The amount of water discharged through the outlet during each flushing operation can be reduced by mounting a flush control device on the arm of the valve control. The flush control device is a rectangular parallelepipedic body with a groove in one side thereof for mounting the body on the arm. A slot extends into the groove from one end of the body for facilitating mounting of the body on the arm. The body changes the turning moment on the arm to close the valve before all of the water has been discharged from the tank. Thus, the quantity of water discharged from the tank to the toilet bowl during each flushing operation can be reduced.

6 Claims, 2 Drawing Sheets

TOILET FLUSH CONTROL DEVICE

BACKGROUND OF THE INVENTION

This invention relates to a device for use in a flush toilet, and in particular to a flush control device.

U.S. Pat. No. 2,773,268, which issued to B. Hurko et al on Dec. 11, 1956 describes a flush toilet mechanism of the type including a valve for closing a bottom outlet in a toilet tank, an arm pivotally connected to a support and carrying the valve for opening and closing the outlet, a container connected to the arm, and a float also connected to the arm for controlling closing of the bottom outlet as water is discharged from the toilet tank. Canadian Patent No. 1,074,056, which issued to Clarence E. Phripp et al on Mar. 25, 1980 describes an improvement of the Hurko et al device in the form of an attachment defined by an upwardly opening receptacle pivotally connected to a frame and adapted to be selectively set at a plurality of different orientations with respect to the frame. The frame is attached to the flush toilet mechanism in such a manner that a changing of the orientation of the receptacle with respect to the frame controls the closing of the bottom outlet as water escapes from the tank. The structure in question is decidedly complex, and consequently would be somewhat expensive.

The object of the present invention is to overcome the above-identified problem by providing a relatively simple flush control device for use with a valve control of generally the same type as disclosed by the above-mentioned Hurko et al U.S. patent.

BRIEF SUMMARY OF THE INVENTION

Accordingly, the present invention relates to a flush control device for use on a valve control in a toilet tank having a bottom outlet for discharging water to a toilet bowl, a valve for closing the outlet, a conventional actuation lever and a chain connecting the lever to the valve for opening the latter, the valve control including an arm carrying the valve pivotally mounted in the toilet tank for actuation by the chain to open the bottom outlet, a float on the arm biasing the valve to the open position when the tank is full and biasing the valve to the closed position when the tank is empty, and a drainable contained on the arm biasing the valve open when the latter is open and biasing the valve closed when the latter is closed, the flush control device comprising body means adapted to be mounted on said arm for adjusting the downward force on said arm to control the closing of said valve, and consequently the quantity of water discharging through said outlet during each flushing action.

BRIEF DESCRIPTION OF THE DRAWINGS

The invention will be described in greater detail with reference to the accompanying drawings which illustrate a preferred embodiment of the invention, and wherein.

DESCRIPTION OF THE PREFERRED EMBODIMENT

Figure 1:
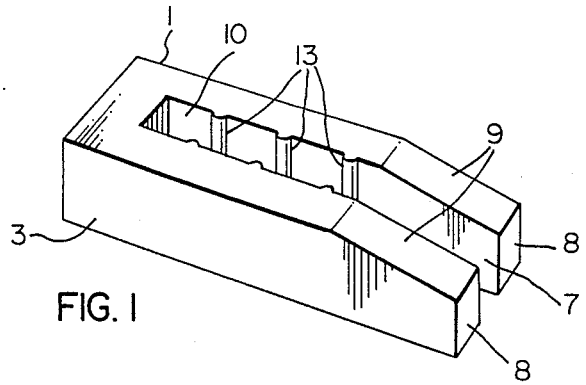
FIG. 1 is a perspective view from the bottom and one end of a flush control device in accordance with the present invention.
Figure 2:
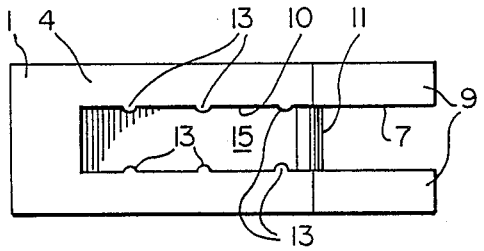
FIG. 2 is a bottom view of the device of FIG. 1.
Figure 3:
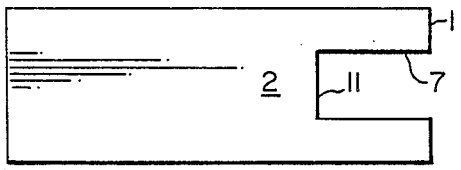
FIG. 3 is a plan view of the device of FIGS. 1 and 2.
Figure 4:
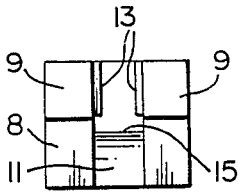
FIG. 4 is an end view of the device of FIGS. 1 to 3.

With reference to FIGS. 1 to 4, the device of the present invention includes an elongated, generally rectangular, solid body 1 with planar top, side and bottom walls 2, 3 and 4, respectively. A rectangular, generally U-shaped slot 7 extends inwardly from one planar end 8 of the body 1 approximately one third of the distance towards the other end. A bottom corner 9 of the body 1 on each side of the slot 7 is bevelled for facilitating mounting of the body 1 on a flush valve control as described hereinafter in greater detail. A rectangular groove 1 is provided in the bottom surface 4 of the body 1. The groove 10 extends from the inner end 11 of the slot 7 to a position close to the other end of the body 1. A plurality of vertically extending, convex ribs 13 are provided on the opposed inner surfaces of the groove 10. The ribs 13 on each surface of the groove 10 are spaced equidistant apart, and are opposed by similar ribs 13 on the other inner surface of the groove 10. The ribs 13 terminate a short distance above the bottom wall 15 of the groove 10. The free end of the bottom wall 15. defines the inner end 11 of the slot 7. Such inner end 11 is rounded for facilitating mounting of the device on a flush valve control.

Figure 5:
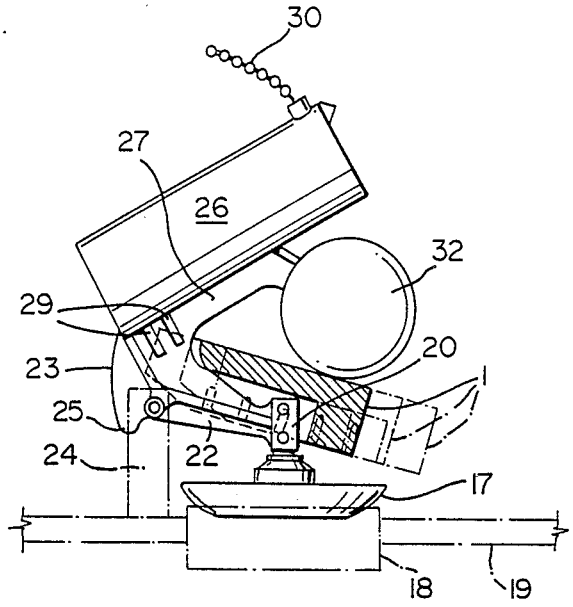
FIG. 5 is a side elevation view of a valve control structure and a sectional view of the device of FIGS. 1 to 4 in the use position.

With reference to FIG. 5, the weight 1 is intended for use on a flush control device of the type including a valve 17 for closing a bottom outlet 18 in the base 19 of a toilet tank (not shown). The valve 17 is pivotally mounted on one cylindrical end 20 of an arm 22 of generally V-shaped lever 23. Thus, the valve 17 can rotate to seat properly on the tank outlet 18. The lever 23 is pivotally mounted on a post 24 extending outwardly from the bottom of the toilet tank for moving the valve 17 between the closed position (FIG. 5) and an open position (not shown). In the open position, a projection 25 on the lever 23 abuts a stop (not shown) on the post 24. A cylindrical reservoir or container 26 is fixedly mounted on the other arm 27 of the lever 23. Reinforcing ribs or gussets 29 extend between the container 26 and the arm 27. In the fully open position of the valve 17, the container 26 is in a vertical position, and is initially full of water. As the tank drains, the water escapes from the container 26 through a hole (not shown) in the bottom thereof. A chain 30 connects the top end of the container 26 to a conventional flush actuating lever (not shown) for moving the valve 17 to the open position. The arm 27 of the lever 23 also supports a hollow spherical float 32, which tends to retard closing of the valve 17.

When the valve 17 is closed, the container and the water therein press downwardly biasing the valve to the closed position, and the float 32 biases the valve toward the open position. The weight of the container 26 and the water therein must overcome the buoyancy effect of the float 32. During normal operation of the valve control structure without the device 1 of the present invention, when the flush container actuating lever is actuated, the chain 30 pulls upwardly on the container 26 causing the lever 23 to rotate around a horizontal axis at the top end of the post 24. This movement of the lever 23 causes the valve 17 to move to the open position. Water is discharged from the tank. As the water level in the tank drops, water is discharged from the hole in the bottom of the container 26. Once the water reaches a pre-determined level, the weight of the valve 17 and the float 32 (which is above the water level) cause the lever 23 to rotate in a clockwise direction, returning the valve 17 to the closed position.

By adding the device 1 to the arm 22 of the lever 23, the water level at which the valve 17 closes can be changed. If the device is slid fully onto the arm 22, the ribs 13 will hold the device in position. The turning moment of the arm 22 around the horizontal axis at the top end of the post 24 is increased, so that the valve 17 closes before the tank is completely drained. By moving the arm outwardly to one of the two positions shown in phantom outline in FIG. 8, the turning moment on the arm 22, and consequently on the entire control device, can be increased so that even less water is discharged from the toilet tank during each flushing action. Thus, it is a relatively simple matter to adjust the amount of water discharged from the toilet tank during each flushing action.

What is claimed is:

1. A flush control device on a valve control in a toilet tank having a bottom outlet for discharging water to a toilet bowl, a valve for closing the outlet, a conventional actuation lever and a chain connecting the lever to the valve for opening the latter, the valve control including an arm carrying the valve pivotally mounted in the toilet tank for actuation by the chain to open the bottom outlet, a float connected with the arm biasing the valve toward the open position when the tank is full and biasing the valve toward the closed position when the tank is empty, and a drainable container on the arm biasing the valve open when the latter is open and biasing the valve closed when the latter is closed, the flush control device comprising body means adjustably mounted on said arm between said float and said valve for variably adjusting the downward force on said arm by adjustable movement along the arm to control the closing of said valve, and consequently the quantity of water discharging through said outlet during each flushing action, wherein said body means includes groove means in a bottom surface thereof receiving said pivotally mounted arm and mounting said body means on the arm, wherein said body means includes slot means extending vertically through the body means and communicating with said groove means for facilitating mounting of said body means on the arm, and including rib means in said groove means for retaining the device on the arm, and wherein said body means defines a rectangular parallelepiped, said groove means being in one surface thereof, and said slot means extending inwardly from one end of said body means into said groove means for facilitating mounting of the body means on said arm.

2. A flush control device on a valve control in a toilet tank having a bottom outlet for discharging water to a toilet bowl, a valve for closing the outlet, a conventional actuation lever and a chain connecting the lever to the valve for opening the latter, the valve control including an arm carrying the valve pivotally mounted in the toilet tank for actuation by the chain to open the bottom outlet, a float connected with the arm biasing the valve toward the open position when the tank is full and biasing the valve toward the closed position when the tank is empty, and a drainable container on the arm biasing the valve open when the latter is open and biasing the valve closed when the latter is closed, the flush control device comprising body means adjustably mounted on said arm between said float and said valve for variably adjusting the downward force on said arm by adjustable movement along the arm to control the closing of said valve, and consequently the quantity of water discharging through said outlet during each flushing action, wherein said float means lies above said arm and said valve, and said body means is an elongate body member formed with an elongate groove in the lower surface such that said arm lies in said groove, said groove being closed at one end and open at its other end such that said elongate member can be axially inserted between said arm and valve, on the one hand, and said float, on the other hand, with the arm disposed to a greater or lesser extent in said groove, said closed end of said groove defining the maximum degree of insertion when it abuts the pivotal end of said arm.

3. Apparatus as claimed in claim 2 wherein, at the open end of said groove, the upper surface of said body member is removed to form a through slot laterally boundaried by spaced axially extending portions of said body member so as to define a topless continuation of said groove.

4. Apparatus as claimed in claim 3 wherein the lower surfaces of said spaced axially extending portions are beveled.

5. Apparatus as claimed in claim 4 wherein the body member portion forming the roof of said groove is rounded at the open end of said groove at said through slot.

6. Apparatus as claimed in claim 5 further comprising a plurality of spaced laterally extending ribs formed in the lateral walls of said groove for retaining the body member on the arm in a selected axially adjusted position.

* * * * *